US010735850B2

(12) United States Patent
Größler et al.

(10) Patent No.: US 10,735,850 B2
(45) Date of Patent: Aug. 4, 2020

(54) LOUDSPEAKER

(71) Applicant: Burmester Audiosysteme GmbH, Berlin (DE)

(72) Inventors: Stefan Größler, Berlin (DE); Robert Horbach, Berlin (DE); Martin Lorenz, Berlin (DE); Pascal-Philippe Bings, Berlin (DE)

(73) Assignee: BURMESTER AUDIOSYSTEME GMBH, Berlin (DE)

( * ) Notice: Subject to any disclaimer, the term of this patent is extended or adjusted under 35 U.S.C. 154(b) by 0 days.

(21) Appl. No.: 16/097,367

(22) PCT Filed: Apr. 29, 2016

(86) PCT No.: PCT/EP2016/059686
§ 371 (c)(1),
(2) Date: Oct. 29, 2018

(87) PCT Pub. No.: WO2017/186312
PCT Pub. Date: Nov. 2, 2017

(65) Prior Publication Data

US 2019/0149907 A1 May 16, 2019

(51) Int. Cl.
*H04R 1/02* (2006.01)
*H04R 1/26* (2006.01)
(Continued)

(52) U.S. Cl.
CPC ..... *H04R 1/26* (2013.01); *H04R 1/025* (2013.01); *H04R 1/323* (2013.01); *H04R 1/345* (2013.01); *H04R 2201/025* (2013.01)

(58) Field of Classification Search
CPC ..... H04R 1/26; H04R 1/025; H04R 1/323; H04R 1/345; H04R 2201/025; H04R 5/02
(Continued)

(56) References Cited

U.S. PATENT DOCUMENTS 3,903,989 A 9/1975 Bauer
4,054,750 A 10/1977 Montgomery et al.
(Continued)

FOREIGN PATENT DOCUMENTS

JP 60146599 A 8/1985
JP 0390194 U 9/1991
(Continued)

OTHER PUBLICATIONS

International search report for patent application No. PCT/EP2016/059686 dated Jan. 13, 2017.
(Continued)

*Primary Examiner* — Paul Kim
*Assistant Examiner* — Ubachukwu A Odunukwe
(74) *Attorney, Agent, or Firm* — Bachman and Lapointe PC; George Coury

(57) ABSTRACT

The present invention refers to a loudspeaker. Soundwaves generated by a loudspeaker according to the prior art are emitted into a room or into the surrounding space in a predetermined geometric structure. It is a task of the present invention to provide a loudspeaker, which has an improved spatial acoustic performance. According to an embodiment of the invention, the loudspeaker comprises a housing, at least one driver arrangement and a mounting device including a movable mechanism for mounting the driver arrangement to the housing. The driver arrangement comprises at least one electroacoustic driver. With the help of the mounting device the driver arrangement is mounted to the housing in different predetermined positions, wherein the mounting device is adapted such, that the driver arrangement can be arranged in at least a first position and at least a second position with respect to the housing.

19 Claims, 3 Drawing Sheets

(51) Int. Cl.
*H04R 1/34* (2006.01)
*H04R 1/32* (2006.01)

(58) Field of Classification Search
USPC ..... 381/305, 387, 345, 347; 181/199
See application file for complete search history.

(56) References Cited

U.S. PATENT DOCUMENTS

| | | | | |
|---|---|---|---|---|
| 2007/0086615 | A1* | 4/2007 | Cheney | H04R 1/345 381/338 |
| 2007/0144826 | A1* | 6/2007 | An | H04R 1/26 181/199 |
| 2008/0063225 | A1* | 3/2008 | Choi | H04R 1/025 381/305 |

FOREIGN PATENT DOCUMENTS

| | | | |
|---|---|---|---|
| JP | 0993690 | A | 4/1997 |
| JP | 2012205240 | A | 10/2012 |
| WO | 2004064369 | A2 | 7/2004 |

OTHER PUBLICATIONS

Japanese office action for patent application No. 2019-507994 dated Jan. 21, 2020.
Korean office action for patent application No. 10-2018-7033125 dated Feb. 25, 2020.

* cited by examiner

LOUDSPEAKER

TECHNICAL FIELD

The present invention refers to a loudspeaker. Usually, a loudspeaker comprises a housing and at least one acoustic driver for transducing electrical signals in soundwaves, respectively in an acoustic signal. Such loudspeakers—also called loudspeaker box—are used in standard stereo equipment, mostly in a set of two for obtaining an acoustic stereo effect.

PRIOR ART

Such loudspeakers are widely known and commonly include a plurality of drivers, for example a woofer driver (bass driver). By such woofer driver an electric audio signal is transduced via a voice coil and a diaphragm into soundwaves of—with respect to the human audible frequency—medium to low frequency. For obtaining high fidelity (hi-fi) reproduction of sound a tweeter driver, a mid-range driver and/or a woofer driver are arranged in the same housing. Each driver reproduces a part of the audible frequency range.

Furthermore, a certain type of loudspeaker comes with a bass reflex tube mounted in the housing, also known as (reflex-) port or vent. By such measure, these loudspeakers use the sound from the rear side of the diaphragm to increase the efficiency at low frequencies.

The published German patent application 1 812 596 describes a loudspeaker system includes a woofer in a large enclosure. A pair of smaller speakers is supported on the top of the enclosure closely adjacent to the front edge with the axes of these small loudspeakers subtending an angle of substantially 90°. Both, woofer and small speakers radiate energy over a common middle frequency range.

DISADVANTAGES OF THE PRIOR ART

Soundwaves generated by a loudspeaker according to the prior art are emitted into a room or into the surrounding space in a predetermined geometric structure. Said structure is mainly influenced by the very position of the loudspeaker and the acoustic driver thereof with respect to the related room or surrounding. Hence, a listening person experiences a variety of acoustic impressions, wherein said impressions differ in acoustic quality and pressure of soundwaves dependently on the position of the listening person within the room or in the surrounding of the loudspeaker.

In order to overcome this problem, loudspeaker systems providing the so-called surround sound are used. Such systems have a plurality of loudspeakers, for example five loudspeakers, which are evenly located in a room and produce an even distribution of soundwaves in this room. These surround sound systems have a high grade of complexity and come with a high number of single components.

PROBLEM TO BE SOLVED

Therefore, it is a task of the present invention to overcome mentioned disadvantages of current loudspeakers and loudspeaker systems. In particular, a loudspeaker shall be provided, which has an improved spatial acoustic performance and thereby provides an acoustic impression, which is less dependent from the very location of the listening person.

SUMMARY OF THE INVENTION

The problem mentioned above is solved by a loudspeaker and by a pair of loudspeakers as disclosed herein. Furthermore, the problem is solved by operating such loudspeaker with the help of a method as disclosed herein.

According to an embodiment of the invention, the loudspeaker comprises a housing, at least one driver arrangement and a mounting device including a movable mechanism for mounting the driver arrangement to the housing.

The housing can be a structure, for example a case-like or a frame-like structure, configured for placing, locating or mounting the loudspeaker to a wall, a floor, a stand or to any other support structure, on which or where the loudspeaker is placed for its operation. Usually, the housing has a front and at least a side, wherein the loudspeaker is arranged such, that the front is facing a listening person—or a listening person locates him/herself such, that the front faces the listening person. The side of the housing not necessarily needs to be an embodied in form of a structural component, but also can be simply a definition of geometric a characteristic of the housing of the loudspeaker box, for example an open side.

The driver arrangement of the loudspeaker comprises at least one electroacoustic driver, commonly also referred as speaker, for transducing electrical signals into acoustic signals, wherein the acoustic signals materialize in form of soundwaves. For example, such driver can be a woofer driver for producing a low range of acoustic frequencies, a middle-range driver or a tweeter driver. Furthermore, the driver arrangement may comprise a structure for supporting the driver or a plurality of drivers in the desired manner.

With the help of the mounting device the driver arrangement is mounted to the housing in different predetermined positions, wherein the mounting device is adapted such, that the driver arrangement can be arranged in at least a first position and at least a second position with respect to the housing. The mounting device may optionally be configured such, that the driver arrangement can be placed with regards to the housing also in intermediate positions between the first position and second position.

Said teaching provides a loudspeaker generating soundwaves, wherein the spatial characteristics of the emitted soundwaves are adaptable and/or can vary dependently on the position the driver arrangement. In especially, for adapting the spatial characteristics of the soundwaves, in particular, for changing a main sound direction of the driver of the driver arrangement, the driver arrangement can be lined up in the first position, in second position or in intermediate positions, wherein a vector of the main sound direction varies dependently on the positions.

The invention generally refers to a loudspeaker, wherein the housing is a case-like structure including an open volume or a closed volume. The housing is not to be referred as being a general mounting device for attaching a loudspeaker or a driver arrangement to the third component.

According to an embodiment the loudspeaker comprises—beside the housing and the driver arrangement—further acoustical effective component, which is not attached or mounted to the driver arrangement. Such component can be an additional driver, a bass reflex tube, cabling or electronic equipment for transmitting electrical signals to a driver of the driver arrangement or to another driver. The mentioned component/s is/are attached or firmly mounted to the housing of the loudspeaker.

The term "main sound direction" shall be understood in this context as one vector representing the vectorial sum of all vectors of all soundwaves being emitted by the driver or by the driver arrangement. Alternatively if the mentioned definition of the main sound direction cannot be proved properly, for example due to measurement issues, the main sound direction solid be defined as a normal direction originating in a geometrical center of a driver and being perpendicular to a main mission plane of the driver. In other words, the main sound direction of the driver starts in its center and leads straight and perpendicular away from it. In case the main sound direction of the driver arrangement is to be defined, the single main sound direction of each driver of said driver arrangement must be taken account accordingly, and their vectors shall be summarized.

According to one embodiment of the invention, the mounting device is adapted, embodied and/or mechanically connected to the driver arrangement and the housing such, that a translational movement, a rotational movement, a translational and/or rotational movement, exclusively a rotational movement or exclusively translational movement is executed by the driver arrangement with respect to the housing in order to arrange the driver arrangement to the housing in the first position, the second position or in the intermediate position.

According to a first embodiment, the driver arrangement is translationally movable mounted to the housing. That means, by configuring the movable mechanism as a translational mechanism the shift from first position to second position of the driver arrangement is performed by a translational movement, in particular in a straight, one-directional movement, and especially not comprising a curve. As a consequence, the main sound direction of the driver does not change its general direction in case of a shift of the driver arrangement. The main sound direction in first position is parallel to the main sound direction in second position.

According to one form of the first embodiment, the translational mechanism and the driver arrangement are configured such and mounted with respect to the housing such, that—with respect to an operational position of the loudspeaker being placed on the ground—the first position of the driver arrangement is more close to the ground than the second position. Hence, the driver of the driver arrangement in second position is higher than the driver of the driver arrangement in first position. This is especially beneficial, if a listening person desires both, to listen to the loudspeaker in a seating position (driver arrangement is in lower, first position), and to listen to the loudspeaker in a standing position (driver arrangement is in higher, second position), for example when dancing or standing at a cocktail party.

Furthermore, the mounting device, the housing and the driver arrangement are adapted such, that the first position (lower position) of the driver arrangement causes the main sound direction of the driver arrangement or the main sound direction of the driver of the driver arrangement to be formed with a distance to the ground, which is about the height of an ear of a seating person. Favorably, the height of the main sound direction with respect to the ground is between 80 cm to 140 cm, preferred between 100 cm and 120 cm.

Additionally, mentioned distance between the driver arrangement in upper position (second position) and the ground, or between the main sound direction of the driver arrangement and the ground is between 150 cm and 220 cm, preferably between 160 cm and 200 cm.

The application of the teaching of the preceding embodiments has a greater effect, if the driver arrangement comprises at least one middle driver and at least one tweeter driver. Since the human acoustic sensing capacity is more sensitive for spatial characteristics of soundwaves of higher to middle frequencies, the experienced sound quality is drastically improved when adapting a main sound direction of tweeter drivers and/or middle drivers according to a position of a listening person.

It is disclosed by a further embodiment, that at least one driver is mounted to the driver arrangement such, that a main sound direction of the driver is directed mainly perpendicular and outwardly with respect to the front of the housing.

According to an optional addition to the embodiment described above, at least one driver is mounted to the driver arrangement such, that a main sound direction of the driver is directed mainly perpendicular and inwardly with respect to the front. With the help of such addition the driver arrangement has two sources of sound (drivers), wherein the vectors of both main sound directions of the inwardly and outwardly turned driver are parallel, but are opposing each other.

An inwardly directed driver shall not be taken into account for the definition of the main sound direction.

The optional addition as mentioned above may be embodied such, that the driver being directed outwardly is a first tweeter driver, and the driver being directed inwardly is a second tweeter driver. By this, the higher audible frequencies produced by the driver arrangement of the loudspeaker are emitted into opposing main sound directions, which improves a spatial in mission of such audible frequencies.

Furthermore, an independent embodiment is disclosed: The movable mechanism is a rotational mechanism, which is embodied such, that a shift from the driver arrangement's first position into the second position—and vice versa—is executed by performing the rotational movement. Thus, the driver arrangement rotates with respect to the housing when changing positions, and a main sound direction of the driver of the driver arrangement rotates accordingly.

With regards to the embodiment mentioned above, the main sound direction of the driver arrangement in first position is mainly parallel to the front of the housing. In second position, the main sound direction of the driver arrangement is mainly perpendicular to the front. For enabling such rotational behavior, the rotational mechanism is configured accordingly.

It is an advantage for listening persons, if the main sound direction of the driver shall pan between a first direction and a second direction. For example in one situation, a listening person might desire to be directly confronted by soundwaves in order have an intense acoustic experience. In another situation, such intense, directly confronting acoustic experience shall be prevented, thus, the driver arrangement and the driver is turned away from the listening person.

In accordance to any form of the independent embodiments as mentioned above, the driver arrangement comprises at least one woofer driver and a resonance casing which is supporting the woofer driver. Because of the human ability of physically sensing relatively low frequencies "by the stomach", a listening person might find it especially beneficial, if a driver arrangement producing soundwaves of relatively low frequencies can be panned back and forth. Said physical experience of low soundwaves is sometimes highly desired, for example while dancing to electronic music. Sometimes such physical experience of sound must be prevented, for example when listening to jazz or classical music.

Additionally or alternatively to the embodiments as mentioned above, and now the independent aspect of the invention shall be presented: the loudspeaker comprises a first driver arrangement and a second driver arrangement. The first driver arrangement can be embodied according to one of the embodiments of the translational, shiftable driver arrangement as mentioned above. The second driver arrangement is according to the rotational embodiment. Hence, the loudspeaker has at least one translational, shiftable driver arrangement and at least one rotatable driver arrangement, both are shiftable/rotatable with respect to the housing of the loudspeaker. This comes with major benefits for the adaptation of spatial characteristics of the emitted sound to the preferences of the listening person. Accordingly, the loudspeaker comprises a first mounting device including the translational mechanism for mounting the first driver arrangement to the loudspeaker, and a second mounting device including the rotational mechanism for mounting the second driver arrangement to the loudspeaker.

It is an optional embodiment of the independent aspect to configure the translational mechanism such, that a main sound direction of the first driver arrangement, in first and second position, is mainly perpendicular to the front of the housing.

Furthermore, the second driver arrangement is configured such, that, when being in first position, the main sound direction of the second driver arrangement is directed mainly perpendicular to the main sound direction of the first driver arrangement. When being in second position, the main sound direction of the second driver arrangement is directed parallel to the main sound direction of the first driver arrangement.

With regards to the independent aspect of the invention as described, the housing of the loudspeaker is designed in a frame-like shape having an open side. The first driver arrangement is located in an area of the front of the housing, wherein the front is perpendicular to the open side, and wherein the open side is larger than the front. Furthermore, the second driver arrangement, in particular comprising the resonance casing and the woofer, is at least partially mounted within the housing, and consequently it is surrounded by the frame-like shape, thus by the housing.

According to another form of the embodiment, the rotational mechanism of the second mounting device is adapted, that a rotational angle between second driver arrangement's first position and second position is substantially at least 90°.

It is summarized in one possible embodiment, that the main direction of the first driver arrangement is perpendicular to the front of the housing, wherein the main sound direction of the second driver can be rotated by 90° such, that in the first position, the main sound direction of the second driver arrangement is perpendicular to the main sound direction of the first driver arrangement, and in the second position, the main sound direction of the second driver arrangement is parallel to the main sound direction of the first driver arrangement.

The housing of the loudspeaker, in especially the frame-like shape of the housing of the loudspeaker and the second driver arrangement, in particular the resonance casing of the second driver arrangement, are designed and have the geometrical characteristics such, that—when being in first position—the second driver arrangement is fully embraced by the frame-like shape of the housing and substantially does not protrude the housing, in especially the open side of the housing. By this measure, the aesthetic appearance of the overall loudspeaker is improved. In particular, the depth (the broadness of the open side) of such loudspeaker is larger than the front of the loudspeaker; hence, in case the second driver arrangement is in first position, the loudspeaker has a slender appearance.

When being in second position, the second driver arrangement is rotated out of the frame-like shape and therefore overlaps the frame-like shape, in particular on both sides. Then, both main sound directions of both driver arrangements are mainly parallel and confront a listening person being in front of the loudspeaker.

According to a further embodiment, the second driver arrangement comprises a reflection surface. Such reflection surface is arranged on or by woofer surface of the resonance casing. The reflection surface is suitable to reflect soundwave, in particular without or with only small absorption of soundwaves.

This reflection surface is arranged on the second driver arrangement such that,—in second position of the second driver arrangement—the reflection surface is in front of a inwardly directed driver of the first driver arrangement according to the embodiment as described in paragraph [0024] to [0026]. Hence, the reflection surface reflects soundwaves being emitted by the inwardly located driver of the first driver arrangement. Together with the outwardly directed driver of the first driver arrangement the reflected soundwaves of the inwardly directed driver creates an improved spatial acoustic experience for the listening person.

According to a further embodiment of the invention, the loudspeaker comprises a detection device for identifying a body posture of a person being in the same area as the loudspeaker. Such detection device is designed to identify if a person in the surrounding of the loudspeaker, in particular in front of the loudspeaker, is seating or standing. In particular, the detection device is suitable to understand, if a person or a group of persons in a detection area of the detection device is standing or moving and dancing. By this measure the position of a driver arrangement can be automatically chosen and adjusted by the detection device or by a control software thereof.

For example, if the detection device interprets a situation of listening persons as being quiet and/or that the listeners are seated, the first driver arrangement might be in lower, first position and the second driver arrangement is in first position such, that the listening persons are not directly confronted by soundwaves created by the second driver arrangement.

Furthermore, a method for operating a loudspeaker having a first driver arrangement and a second driver arrangement as described above is disclosed, wherein said method comprises a first operating mode and a second operating mode.

In particular, when being in first operating mode, the first driver arrangement is in first position and the second driver arrangement is in first position, too. Consequently, when operated in first operating mode, the main sound direction of the second driver arrangement is mainly perpendicular with regards to the main sound direction of the first driver arrangement.

In case the loudspeaker is operated in second operational mode, the first driver arrangement is in second position and the second driver is in second position. Then, the second driver arrangement is rotated out of the frame-like shape and both main sound directions of both driver arrangements are mainly parallel aligned. Furthermore, the main sound direction of the first driver arrangement is in high position.

Optionally, the method can be adapted such, that the decision for operating the loudspeaker in first operational mode or in second operational mode is dependent on a position of the listening person or of a group of listening persons in the surroundings of the loudspeaker.

In the context of this invention a pair of loudspeaker is provided, which comprise a first loudspeaker and a second loudspeaker. Such loudspeakers are embodied according to an embodiment, form, aspect of the loudspeakers as described above or to a combination thereof.

For obtaining an improved acoustic effect for a listening person, the first and the second loudspeaker both comprise a second driver arrangement, which is rotatable arranged within the frame-like shape of the housing. Furthermore, the first loudspeaker and the second loudspeaker are configured such, that a first rotational direction of the first loudspeaker, when moving the second driver arrangement of the first loudspeaker from first position in second position is directed opposite with regards to a second rotational direction of the second loudspeaker, when moving the second driver arrangement of the second loudspeaker from first position in the second position. Consequently, the rotational movement of the second driver arrangement of the first loudspeaker is a mirror image of the rotational movement of the other second driver arrangement of the second loudspeaker. This comes with improved spatial sound characteristics and an harmonized impression for the listening person.

The mentioned problem is independently solved by a loudspeaker according to any or a plurality of the preceding embodiments or to a practical combination of the embodiments and forms thereof as mentioned above. The embodiments as described above can be combined with each other in a practical and appropriate manner. Hence, the invention is not necessarily limited to single embodiments shown above and in the following.

DESCRIPTION OF FIGURES

The attached figures display various embodiments and thereby serve in conjunction with the description for explaining the principles of the invention. Single features depicted in the figures are shown relatively with regards to each other and therefore are not necessarily to scale.

Similar or same elements in the figures, even if displayed in different embodiments, are represented with the same reference numbers.

FIG. 6 is a sectional view A-A of the loudspeaker according to FIG. 5.

FIG. 7 is a sectional view B-B of the loudspeaker according to FIG. 5.

EMBODIMENTS

Figure 1:
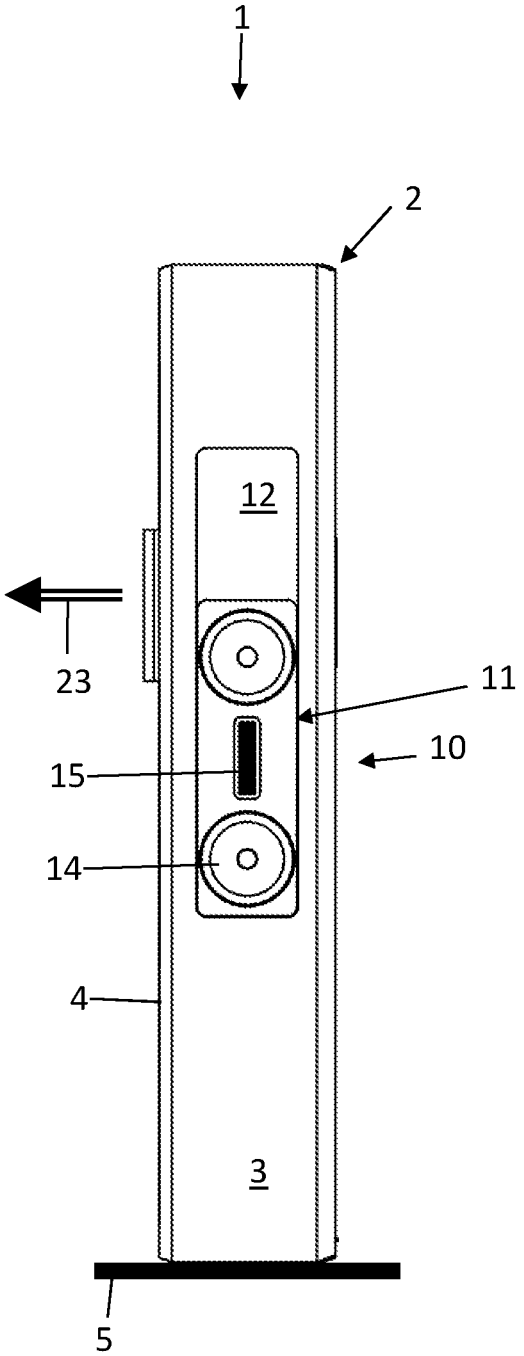
FIG. 1 shows a front view on a loudspeaker with a first driver arrangement in first position.
Figure 2:
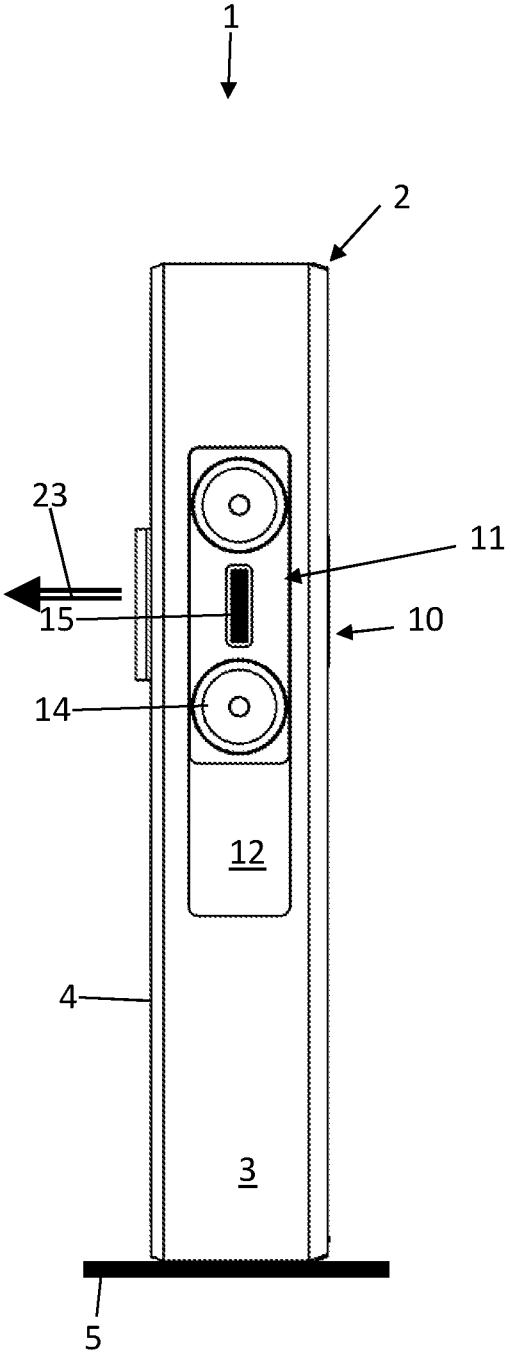
FIG. 2 shows a front view on the loudspeaker according to FIG. 1 with the first driver arrangement in second position.

FIG. 1 and FIG. 2 depict a loudspeaker 1 by a view on the front 3 of the housing 2, wherein the loudspeaker 1 is standing on a ground 5. The front 3 of the housing wall of the housing 2 is carrying the first driver arrangement 10 with the help of the first mounting device 11.

In the present embodiment, the first driver arrangement 10 comprises 2 middle drivers 14 and a first tweeter driver 15, wherein all these drivers 14 and 15 are directed such, that an overall main sound direction 13 of the first driver arrangement 10 is oriented perpendicular to the front 3 and looks outwards with regards to the front 3.

The first driver arrangement 10 is movably mounted to the front 3 with the help of the first mounting device 11, which comprises a translational mechanism 12. The first mounting device 11 and the translational mechanism are jointly functioning as a connective element between the front 3 and the first driver arrangement 10. In particular, the first mounting device 11 includes a movable portion and a non-movable portion. The non-movable portion of the first mounting device 11 is firmly mounted to the front 3 of the housing 2 of the loudspeaker 1, wherein the first driver arrangement 10 is fixed to the movable portion of the first mounting device 11. The translational mechanism 12 is adapted for translationally connecting the movable portion to the non-movable portion such, that the first driver arrangement 10 can be arranged in a first position and in the second position on the housing 2 of the loudspeaker 1.

As shown in FIGS. 1 and 2, the first driver arrangement 10 can be positioned in a lower and in a higher position with regards to the ground 5, wherein mentioned first position is the lower position (FIG. 1), and the high position is the second position (FIG. 2).

If required or desired by the listening person, the first driver arrangement 10 can be placed in lower position (first position, also shown in FIG. 3), for example if the listening person is sitting in front of the loudspeaker 1 or in the surrounding of the loudspeaker 1. In first position, a main sound direction 13 of the first driver arrangement 10 or of a driver 14, 15 of the first driver arrangement 10 has a distance from the ground 5 of about 80 cm to 140 cm, preferred 100 cm and 120 cm. The mentioned components are arranged with recent respect to each other such, that a main sound direction 13 of the driver arrangement 10 is generally in an area of the height of an ear of listening person.

Additionally, the listening person can also execute a change of first driver arrangement's 10 position in the front 3 of the loudspeaker 1. In detail, the first driver arrangement 10 can be brought in upper position (second position, also shown in FIG. 2, FIG. 4 to FIG. 6). The preferred height the main sound direction 13 of the first driver arrangement 10 with respect to the ground 5, or the height of a main sound direction of the driver 14, 15 of the first driver arrangement 10 with respect to the ground 5, is between 150 cm and 220 cm, preferably between 160 cm and 200 cm. The height of the first driver arrangement 10 is chosen such, that a main sound direction 13 of the driver arrangement 10 is generally in an area of the height of an ear of a standing person.

Figure 3:
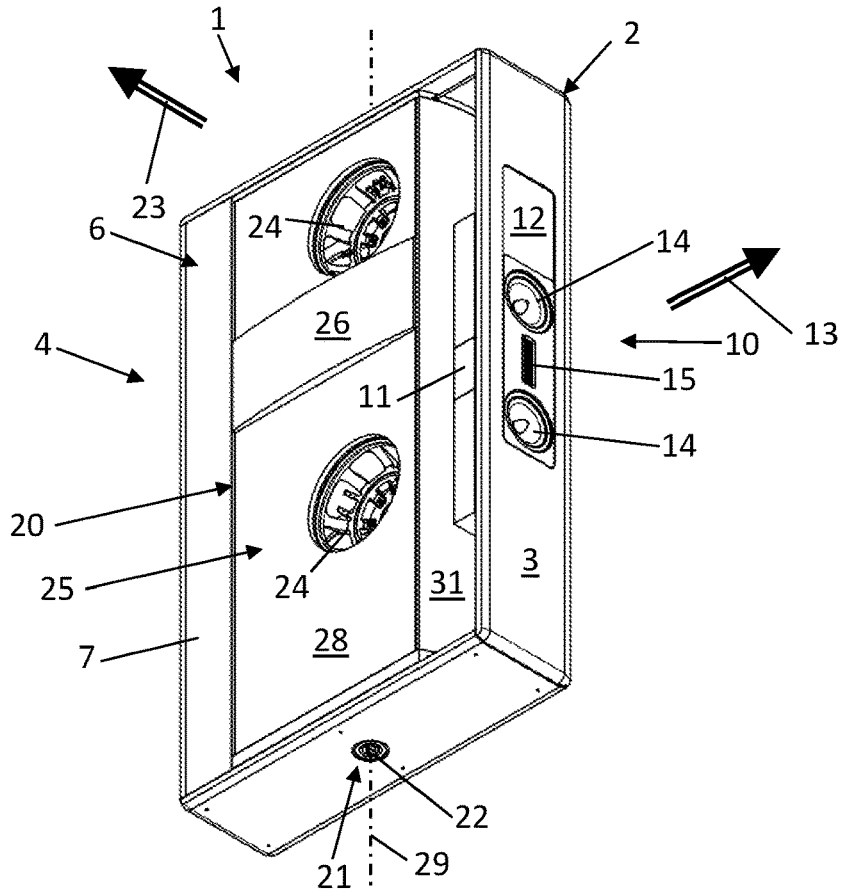
FIG. 3 is a perspective view on the loudspeaker according to FIG. 1 with a second driver arrangement in first position.
Figure 4:
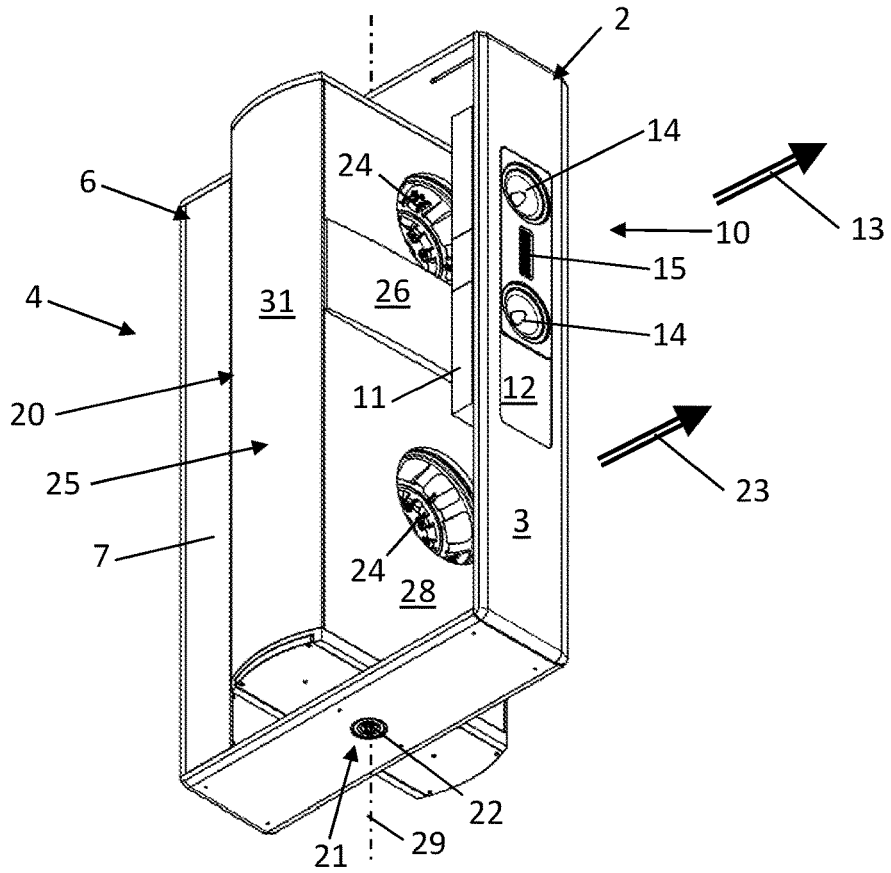
FIG. 4 is a perspective view on that the loudspeaker according to FIG. 2 with the second driver arrangement in second position.

FIG. 3 and FIG. 4 shows the loudspeaker 1 in a perspective view, wherein the first driver arrangement 10 and the second driver arrangement 20 can be seen. As described, the first driver arrangement 10 is mounted to the frame-like housing 2 by the first mounting device 11 including the translational mechanism 12. The housing 2 comprises the front 3 and, due to its frame-like shape, an open side 6, which is rather an imaginary plane covering the frame opening of the housing 2 than a structural side component.

Additionally or optionally, the embodiment shown in FIG. 3 and FIG. 4 also depict the second driver arrangement 20. In the present embodiment, the second driver arrangement 20 comprises a resonance casing 25 having a woofer surface 28, in which two woofer drivers 24 are placed. Consequently, the second driver arrangement 20 is at least partially arranged within the frame-like shape of the housing 2.

With the help of the second mounting device 21 the second driver arrangement 20 is rotatably mounted to the housing 2, in particular to in upper and lower side of the housing 2. The second mounting device 21 comprises a rotational mechanism 22, which is effectively placed between the housing 2 and the resonance casing 25 of the second driver arrangement 20. As shown in FIG. 3 with respect to FIG. 4, the second driver arrangement 20 can be rotated around its mainly vertical rotational axis 29 such, that in its first position (FIG. 3) a main sound direction 23 of the woofer drivers 24 are directed perpendicular with regards to the open side 6 the housing 2, and consequently perpendicular to the main sound direction 13 of the first driver arrangement 10.

In first position, the second driver arrangement 20 is completely within the volume of the frame-like housing 3, and the woofer surface 28 does not extend beyond the open side 6 of the housing 3. However, the second driver arrangement 20 may extend the open side 6 in a minor way; still, the woofer surface 28 including the woofer driver 24 is mainly parallel to the open side 6.

When rotated in second position, the second driver arrangement 20 has an angle of substantially 90° with respect to the first position. Consequently, the main sound direction 23 of the second driver arrangement 20 is arranged parallel to the main sound direction 13 of the first driver arrangement 10. Thus, both main sound directions 13 and 23 are directly facing a listening person standing in front of front 3 of the housing 2 of the loudspeaker 1.

Analogous to the mentioned above, the listening person can choose the position of the second driver arrangement 20 according to his/her desire. For a full impact experience of the kinetic energy of the soundwaves being emitted by the woofer drivers 24, a listening person might turn the second driver arrangement 20 from first position in second position.

Figure 5:
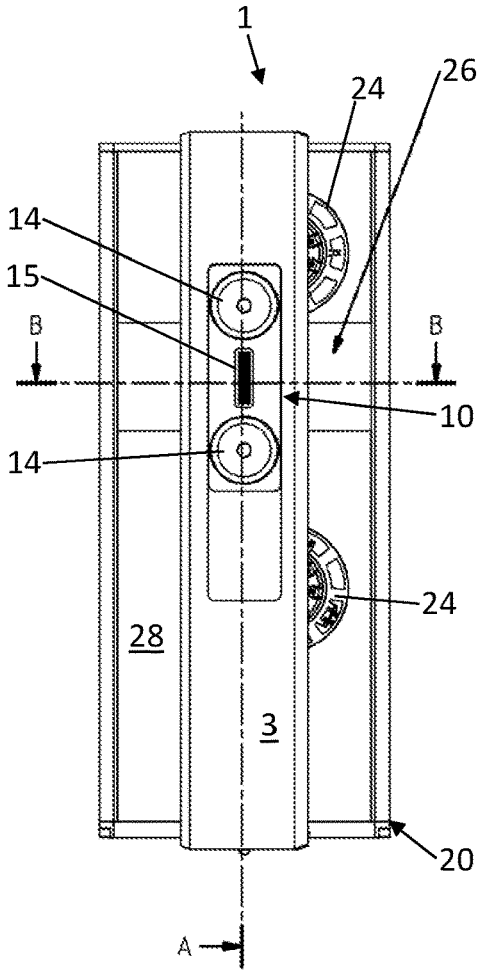
FIG. 5 is a front view on the loudspeaker according to FIG. 3.
Figure 5:
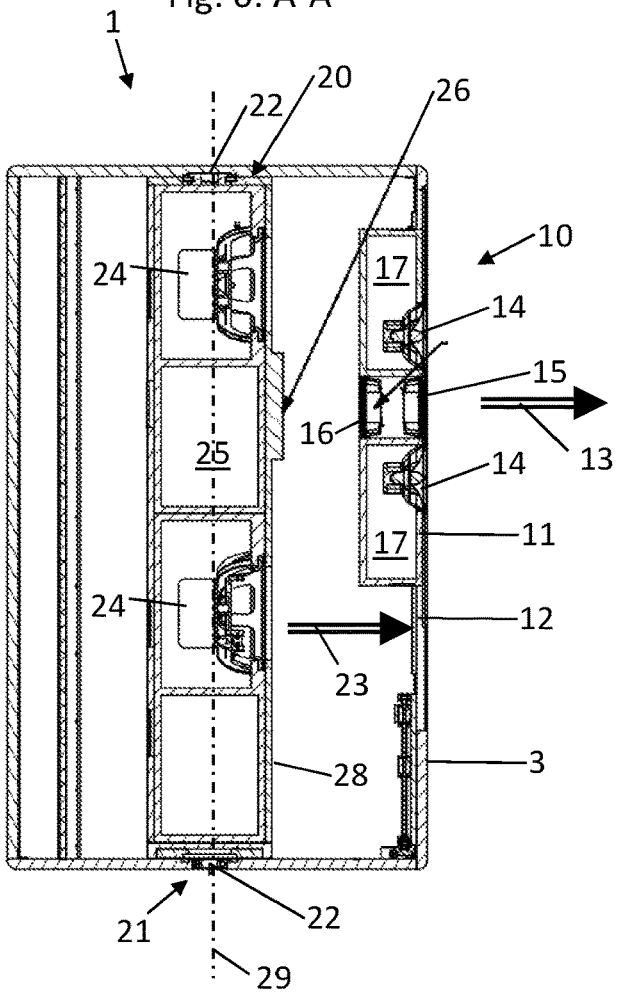
Figure 5:
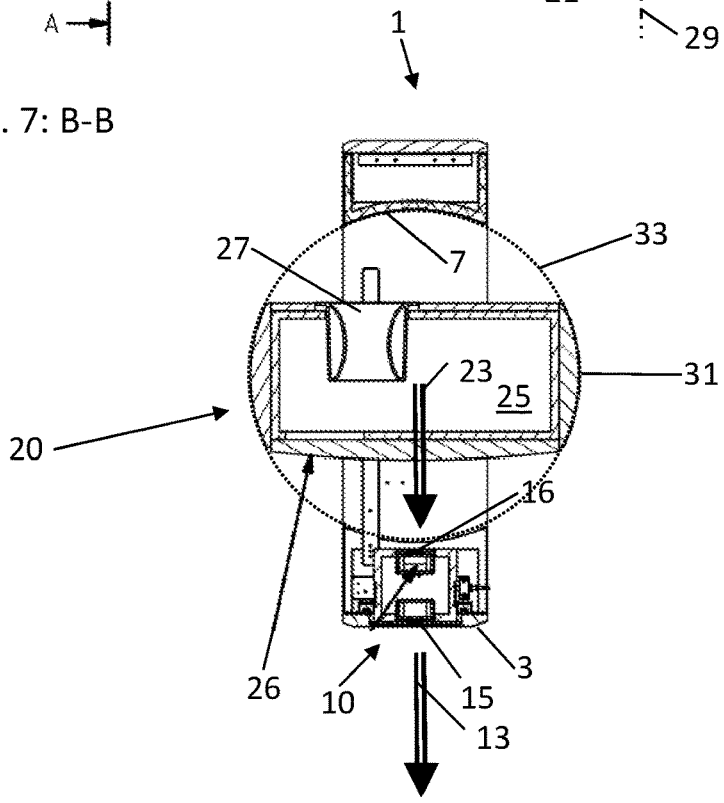

More specific details of the loudspeaker 1 shall be explained with the help of FIG. 5, FIG. 6 and FIG. 7, wherein FIG. 6 and FIG. 7 are sectional views through the loudspeaker 1 as shown in FIG. 5. According to these figures, the second driver arrangement 20 is in second position, hence the second driver arrangement 20 is rotated around axis 29 about 90°, and the main sound direction 23 of the second driver arrangement 20 is mainly parallel to the main sound direction 13 of the first driver arrangement 10.

As depicted in FIG. 6, the second driver arrangement 20 comprises a resonance casing 25 having the woofer surface 28, in which two woofer drivers 24 are placed. The second mounting device 21 having a rotational mechanism 22 for rotating around the axis 29 is placed on an upper side and the lower side of the resonance casing 25 for interacting with an upper side and the lower side of the frame-like housing 2.

FIG. 6 also shows the first driver arrangement 10 in a sectional view: the driver arrangement 10 has two middle drivers 14 being placed in acoustic contact to a small resonance chamber 17 and two tweeter drivers 15 and 16, wherein the first tweeter driver 15 is directed outwardly with regards to the housing 2 and the second tweeter driver 16 is directed inwardly. The main sound direction 13 of the first driver arrangement 10 is the vectorial summation of all sound vectors of soundwaves being emitted of the 2 middle drivers 14 and the first tweeter driver 15. The second tweeter driver 16 shall not be taken into account for the definition of the main sound direction 13 of the first driver arrangement 10.

The second tweeter driver 16 is in emitting its soundwaves mainly towards the second driver arrangement 20, in particular to the woofer surface 28 of the second driver arrangement 20. In order to reflect soundwaves emitted from the second tweeter driver 16, a reflection surface 26 is placed on the woofer surface 28 right in front of the second inward tweeter driver 16—if the second driver arrangement 20 is in the second position. Due to such composition of the second tweeter 16 and the reflection surface 26, an overall well emitted sound with regards to high frequencies is radiated out by both, the first tweeter driver 15 and the second tweeter driver 16 (see also FIG. 7).

FIG. 7 shall mainly explain the rotational movement of the second driver arrangement 20 when changing from first position to a second position, vice versa. The housing 2, the second mounting device 21 and its rotational mechanism 22 is arranged such, that the second driver arrangement 20 rotates in a circle 33. Furthermore, the inner sides 7 of the housing 2 correspond with side faces 31 of the second driver arrangement 20 in a geometrical manner, so that the second driver arrangement 20, when in first position, fits well within the frame-like housing 2.

The resonance casing 25 comprises a bass reflex tube 27 which connects an inner volume of the resonance casing 25 with the environment for improving the sound quality generated by the woofers 24. Said bass reflex tube 27 can be manufactured at least partially from a ceramic material, in particular from porcelain.

The present invention is not limited to the above-described embodiments and modifications and may be embodied in various forms within the gist thereof. For example, the technical features of the embodiments and modifications corresponding to the technical features according to the embodiments and forms described in the Summary of the Invention section may be replaced or combined as appropriate to solve some or all of the above-described problems or obtain some or all of the above-described effects.

For example it lies within the scope of the invention, to provide a loudspeaker having only the first driver arrangement 10, wherein woofers and the corresponding resonance volume is firmly arranged and connected to the housing of the loudspeaker. Consequently, only the position of tweeter drivers and/or middle drivers can be adjusted or choosing.

Furthermore it lies within the extent of the invention, that only the second driver arrangement is arranged movably within the housing of the loudspeaker and middle drivers and/or tweeter drivers are firmly mounted to the housing of the loudspeaker.

REFERENCE NUMBERS

1 loudspeaker
2 housing
3 front
4 side
5 ground
6 frame-like shape
7 inner side
10 first driver arrangement
11 first mounting device
12 translational mechanism
13 main sound direction (first driver arrangement)
14 middle driver
15 first tweeter driver
16 second tweeter driver
17 resonance chamber
20 second driver arrangement
21 second mounting device
22 rotational mechanism
23 main sound direction (second driver arrangement)
24 woofer driver
25 resonance casing
26 reflection surface

27 bass reflex tube
28 woofer surface
29 axis
30 circle
31 side face

The invention claimed is:

1. Loudspeaker (1) comprising a housing (2) having a front (3) for facing a listening person and at least a side (4), in particular being perpendicular to the front (3), a first driver arrangement having at least one electroacoustic driver (14, 15, 16), a first mounting device (11) with a translational mechanism (12) for mounting the first driver arrangement (10) to the housing (2), wherein the translational mechanism (12) is configured such that the driver arrangement (10) is translationally mounted to the housing (2), a second driver arrangement (20) having at least one electroacoustic driver (24), and a second mounting device (21) having a rotational mechanism (22) configured such that the second driver arrangement (20) is rotationally mounted to the housing (2), wherein the first mounting device and the second mounting device (11, 21) are configured such that at least one of the first driver arrangement and the second driver arrangement (10, 20) can be arranged with respect to the housing (2) at least in a first position and in a second position.

2. Loudspeaker (1) according to claim 1, wherein, with respect to an operational position of the loudspeaker (1), the first position of the first driver arrangement (10) is more close to a ground (5) than the second position.

3. Loudspeaker (1) according to claim 1, wherein the first driver arrangement (10) comprises at least one middle driver (14) and at least one tweeter driver (15, 16).

4. Loudspeaker (1) according to claim 1, wherein at least one driver (15) is mounted to the first driver arrangement (10) such that a main sound direction of the driver (15) is directed mainly perpendicular and outwardly with respect to the front (3) of the housing (2), and at least one driver (16) is mounted to the first driver arrangement (10) such that a main sound direction of the driver (16) is directed mainly perpendicular and inwardly with respect to the front (3).

5. Loudspeaker (1) according to claim 4, wherein the first driver arrangement (10) comprises a first tweeter driver (15) being directed outwardly and a second tweeter driver (16) being directed inwardly.

6. Pair of loudspeakers (1) comprising a first loudspeaker according to claim 5 and a second loudspeaker according to claim 5.

7. Pair of loudspeakers (1) according to claim 6, wherein the first loudspeaker and the second loudspeaker are configured such that a first rotational direction of the first loudspeaker, when moving the second driver arrangement of the first loudspeaker from first position in second position is directed opposite with regards to a second rotational direction of the second loudspeaker, when moving the second driver arrangement of the second loudspeaker from first position in the second position.

8. Loudspeaker (1) according to claim 1, wherein in a first position a main sound direction (23) of the second driver arrangement (20) is mainly parallel to the front (3) of the housing (2), and wherein in a second position the main sound direction (23) of the second driver arrangement (20) is mainly perpendicular to the front (3).

9. Loudspeaker (1) according to claim 8, wherein the second driver arrangement (20) comprises at least one woofer driver (24) and a resonance casing (25) carrying the woofer driver (24).

10. Loudspeaker (1) according to claim 1 wherein the first mounting device (11) is configured such that a change between first driver arrangement's (10) first position and second position can be performed exclusively by a translational movement, and wherein the second mounting device (21) is configured such that a change between second driver arrangement's (20) first position and second position can be performed exclusively by a rotational movement.

11. Loudspeaker (1) according to claim 1, wherein the second driver arrangement (20) is configured such that, when being in a first position, a main sound direction (23) of the second driver arrangement (20) is directed mainly perpendicular to the main sound direction (13) of the first driver arrangement (10).

12. Loudspeaker (1) according to claim 1, wherein the second driver arrangement (20) is configured such that, when being in a second position, a main sound direction (23) of the second driver arrangement (20) is directed parallel to the main sound direction (13) of the first driver arrangement (10).

13. Loudspeaker (1) according to claim 1, wherein the housing (2) has a frame-like shape, wherein the first driver arrangement (10) is located in the front (3) of the housing (2) being perpendicular to an opening (7) of the frame-like shape, p1 wherein the opening (7) is larger than the front (3), and wherein the second driver arrangement (20) is mounted at least partially within the housing (2) and is embraced by the frame-like shape of the housing (2).

14. Loudspeaker (1) according to claim 1, wherein a rotational angle between second driver arrangement's (20) first position and second position is at least substantially 90°.

15. Loudspeaker (1) according to claim 1, wherein the housing (2) and the second driver arrangement (20) comprise such geometrical characteristics that the second driver arrangement (20), when being in a first position, is fully arranged within the frame-like shape of the housing (2) and mainly does not protrude the housing (2).

16. Loudspeaker (1) according to claim 1, wherein the second driver arrangement (20) comprises a reflection surface (26), which is arranged on the second driver arrangement (20) such that, when the second driver arrangement (20) is in second position, the reflection surface (26) is in front of a driver (15) of the first driver arrangement (10), which is directed inwardly with respect to the front (3).

17. Loudspeaker (1) according to claim 1, comprising a detection device for identifying a body posture of a person being in the same area as the loudspeaker (1).

18. Method for operating a loudspeaker (1) according to claim 1, wherein in a first operating mode the first driver arrangement (10) is in first position and the second driver arrangement (20) is in first position, and wherein in a second operating mode the first driver arrangement (10) is in second position and the second driver arrangement (20) is in second position.

19. Method according to claim 18 for operating a loudspeaker (1), wherein the loudspeaker (1) is operated in first operating mode if a majority of persons in the area of the loudspeaker (1) is in seated position, and wherein the loudspeaker (1) is operated in second operating mode if a majority of persons in the area of the loudspeaker (1) is in standing position.

* * * * *